United States Patent [19]

Scheingold et al.

[11] 4,423,917

[45] Jan. 3, 1984

[54] ELECTRICAL CONNECTOR HAVING MOVABLE CONTACT UNITS

[75] Inventors: William S. Scheingold, Palmyra; Wilmer L. Sheesley, Dauphin, both of Pa.

[73] Assignee: AMP Incorporated, Harrisburg, Pa.

[21] Appl. No.: 323,000

[22] Filed: Nov. 19, 1981

[51] Int. Cl.[3] ..... H01R 25/02

[52] U.S. Cl. ..... 339/64 M; 339/205

[58] Field of Search ..... 339/1 R, 6 R, 7, 8 A, 339/64 R, 64 M, 204, 205, 278 C

[56] References Cited

U.S. PATENT DOCUMENTS

| | | | |
|---|---|---|---|
| 2,045,547 | 6/1936 | Chatfield | 339/278 C |
| 2,303,425 | 12/1942 | Bickham | 339/64 R |
| 2,954,542 | 9/1960 | Wales | 339/64 |
| 3,251,019 | 5/1966 | Cimino | 339/64 |
| 3,444,504 | 5/1969 | Lynch et al. | 339/221 R |
| 3,723,940 | 3/1973 | Leonard | 339/64 M |

FOREIGN PATENT DOCUMENTS

| | | | |
|---|---|---|---|
| 36226 | 9/1981 | European Pat. Off. | 339/278 C |
| 1513759 | 5/1969 | Fed. Rep. of Germany | 339/278 C |

*Primary Examiner*—John McQuade
*Assistant Examiner*—Gary F. Paumen
*Attorney, Agent, or Firm*—Allan B. Osborne

[57] ABSTRACT

The present invention relates to an electrical connector for receiving two tab-type terminals which may be misaligned relative to the connector and to each other. More particularly, the connector includes one or more elongated, conductive contact units with each unit having tab terminal receiving receptacles at opposing ends and are mounted for both rotational and vertical movement so that the receptacles may receive misaligned tab terminals.

4 Claims, 5 Drawing Figures

ELECTRICAL CONNECTOR HAVING MOVABLE CONTACT UNITS

BACKGROUND OF THE INVENTION

1. The Field of the Invention

The invention disclosed herein relates to connectors having conductive contact units which are movably mounted such that they are permitted a certain degree of movement and are accordingly able to receive misaligned terminals.

2. The Prior Art

U.S. Pat. No. 3,444,504 discloses one form of an electrical connector wherein the contact section has limited movement independent of the housing in which it is positioned. The contact section is attached to a blade section having weak flexural strength which provides the contact section with a certain degree of movement so that it may effectively mate with a misaligned terminal.

SUMMARY OF THE INVENTION

The present invention relates to an electrical connector containing at least one elongated contact unit having a tab terminal receiving receptacle at each end and a mounting section for mounting the unit so that it may rotate about a mounting means and further slide vertically thereon so that the receptacles may receive misaligned tab terminals.

BRIEF DESCRIPTION OF THE DRAWINGS

FIG. 3 is a side elevation cross-sectional view of the electrical connector of FIG. 1 showing misaligned tab terminals received therein;

DESCRIPTION OF THE INVENTION

Figure 1:
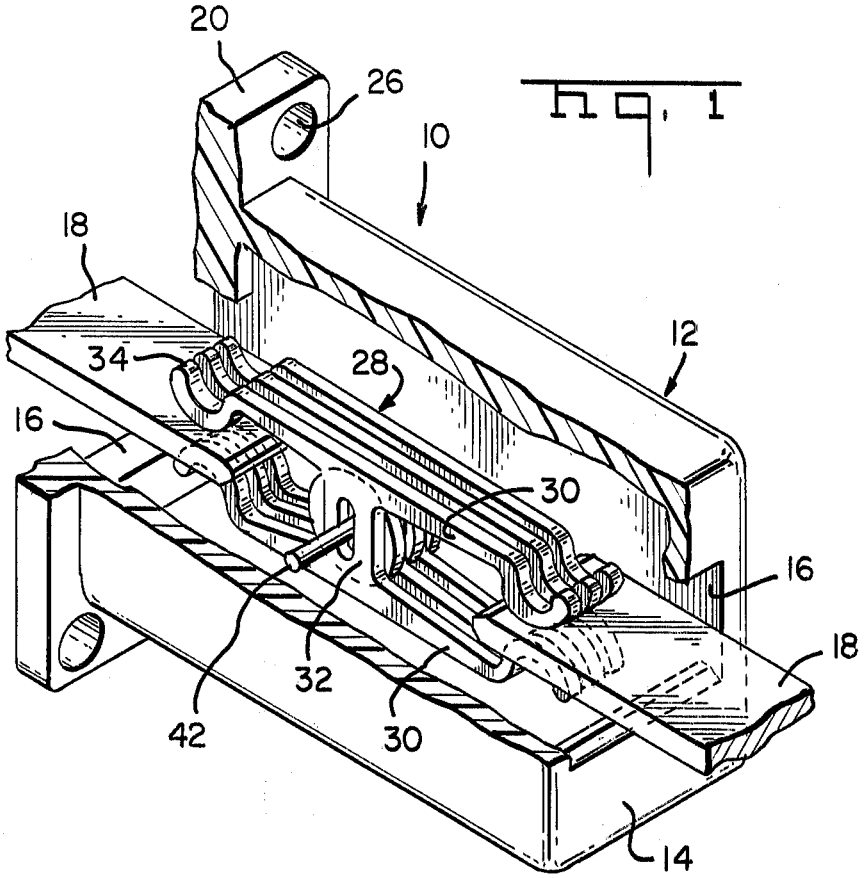
FIG. 1 is a perspective view of the electrical connector of the present invention with a portion of the housing cut away.

The electrical connector of the present invention, indicated generally by reference numeral 10 in the drawings, was originally designed to provide a high current; e.g., 900 amps, connection. The particular use therefore, as illustrated in the drawings, is to provide an electrical connection between a sliding drawer and a rack on a computer. The connector, however, has utility in many other situations and particularly where the terminals being received therein are misaligned. Further, the connector of the present invention may be made for currents of lesser amperage.

Electrical connector 10 includes housing 12 of a suitable insulating material such as glass filled NYLON. Both ends 14 of the housing includes openings 16 through which tab terminals 18 may pass. One end of the housing includes a periphery flange 20 so that the housing may be mounted to the back of drawer 22, FIG. 2, by means of bolts 24 passing through holes 26 in the flange. As the drawing in FIG. 2 shows, one terminal 18 extends out of the drawer.

Figure 2:
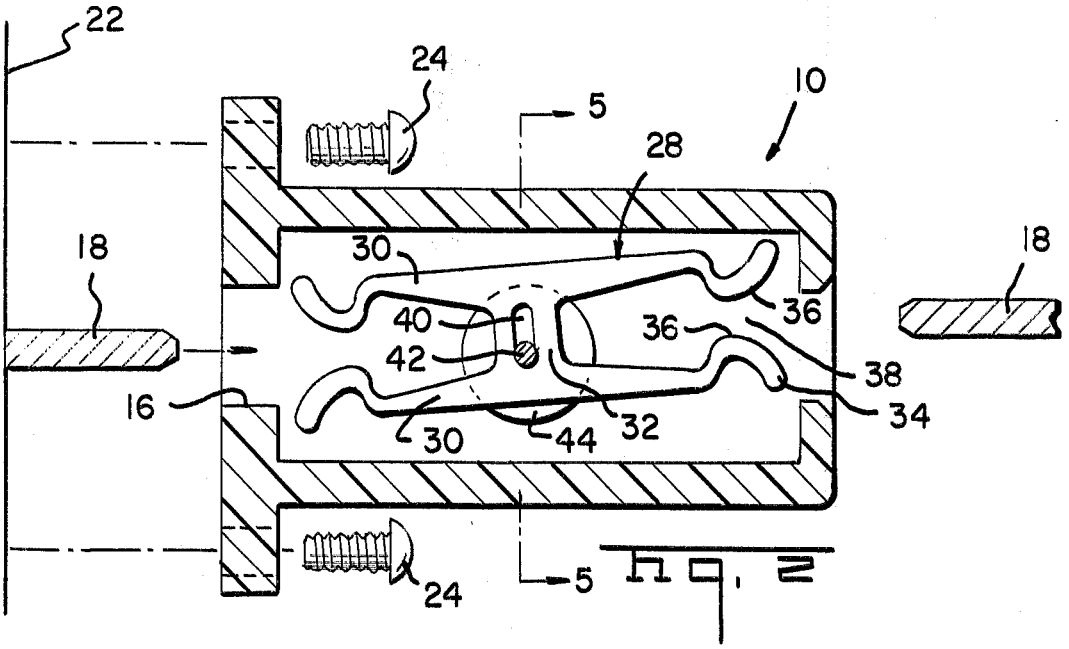
FIG. 2 is a side elevation cross-sectional view of the electrical connector of FIG. 1.
Figure 7:
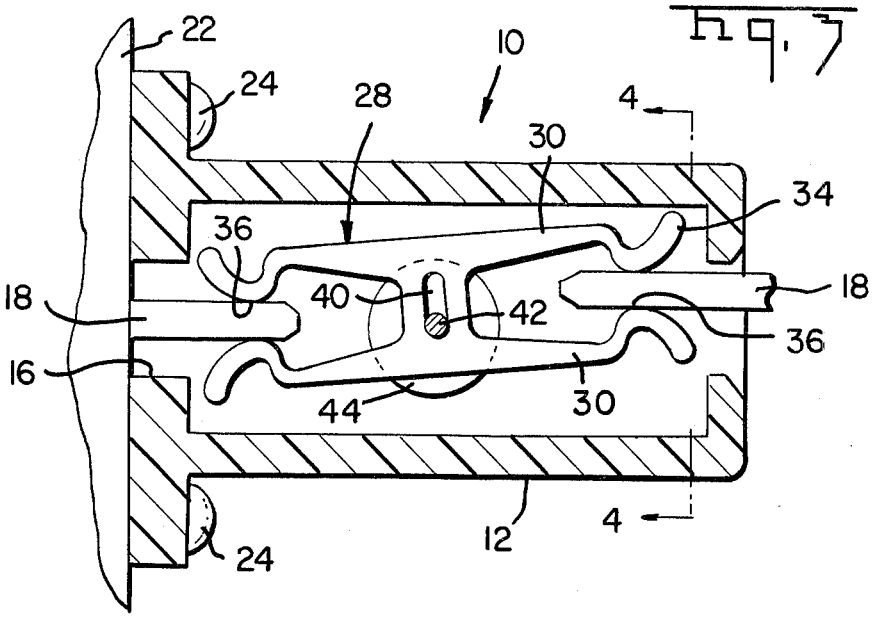

With reference to both FIGS. 1 and 2, one or more conductive contact units 28 are mounted in housing 12. Each unit consists of two elongated, spaced apart, parallel elements 30 that are connected together by a center section 32. The free ends 34 of elements 30, four in number for each unit, have a non-symmetrical, concavo-convex shape with the convex surface 36 being on the inside so as to face towards the convex surface on the adjacent parallel element. A tab terminal receiving receptacle 38 is defined by each pair of facing convex surfaces. Accordingly, there are two receptacles in each unit, one on either side of center section 32. The free ends 34 have a degree of resiliency, the amount being dependent upon the length of the element from center section 32 outwardly, the width and, of course the material used. For the use set forth above, the material is a high strength, high conductive copper alloy; e.g., GLIDOP AL-35 or it's equivalent.

A vertical slot 40 is provided in center section 32.

Means for mounting a unit 28 in housing 12 includes a pin 42, anchored in opposing sidewalls of housing 12 and passing through slot 40. The pin and slot cooperate to allow unit 28 rotational and sliding vertical movement.

With more than one unit 28 positioned in housing 12, spacers 44 are located between each unit. These spacers are preferably made from a low friction plastic.

No specific method of assembling electrical connector 10 is shown. One such method, however, is to place the required number of units 28 within the housing, along with spacers 44, and insert pin 42 through an opening (not shown) in the housing side wall. As assembly methods would be well within the abilities of a skilled artisan, additional discussion relative thereto is deemed not to be necessary.

Figure 4:
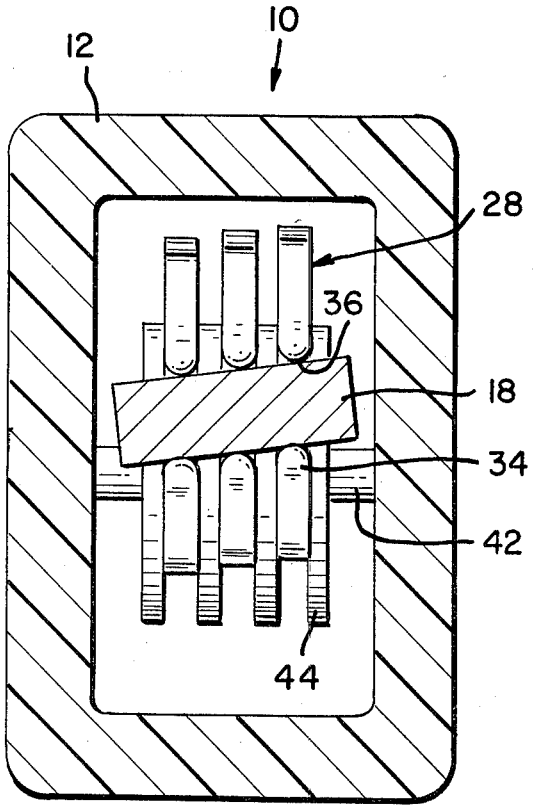
FIG. 4 is an end elevation view taken along line 4—4 of FIG. 3.

FIGS. 2, 3, and 4 illustrate the advantages of an electrical connector 10 constructed in accordance with the present invention. In FIG. 2, the connector is shown being fastened to a drawer 22. The second terminal 18 is fixed to a rack (not shown) such that the two terminals to be electrically joined are misaligned.

In FIG. 3, the drawer with attached connector 10 has been pushed into the rack and the rack terminal 18 received into the connector. In order to receive the rack terminal, units 28 have pivoted about pin 42. The resiliency of the free ends 34, and the sliding and pivoting features accommodates the misalignment.

FIG. 4 is an end cross-sectional view showing how units 28 can be adapted to a tab terminal 18 which is canted to one side. Each unit is free to adjust to the terminal independently of the adjacent units.

Figure 5:
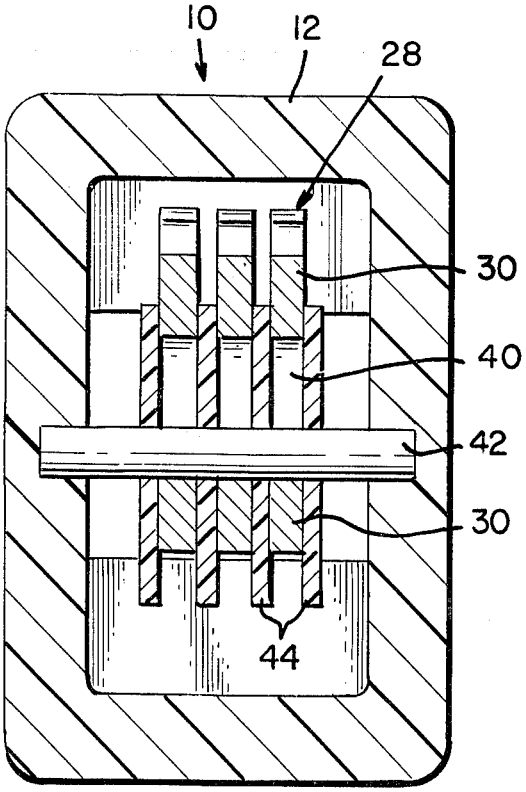
FIG. 5 is an end elevation view taken along line 5—5 of FIG. 2.

FIG. 5 is a cross-sectional view of electrical connector 10 taken along line 5—5 of FIG. 2.

A modification to the present invention reduces arcing and high inrush current during high current usage. The modification is to make one unit longer, of high resistance material, and plate it's convex surfaces 36 with chrome or a similar hard substance. Being longer this unit engages a terminal first. Being of high resistance, the high inrushing current is reduced and by the time mating is made with the shorter units, current flow is normalized. Upon being so mated a low resistance current path is available which minimizes the voltage drop across the connector.

During breaking, there is normally enough inductance in the circuit to set up a high voltage which causes arcing. By restricting the circuit breaking action to the longer, high resistance unit, the erosive action of arcing takes place there; accordingly, the low resistance units are not damaged and can function as a low resistance connection.

Other features of the electrical connector includes two contact surfaces on each unit for each terminal received. The motion of engaging the tab terminals by the contact surfaces results in a wiping action that removes surface films and contaminants so that a clean interface is provided between the mating surfaces. Further, the connector can be tailor made for the desired usage; i.e., the number of units is determined by the allowable resistance drop and temperature rise and by the current to be conducted.

The present invention may be subject to many modifications and changes without departing from the spirit or essential characteristics thereof. The present embodiment is therefore intended in all respects as being illustrative and not restrictive of the scope of the invention.

We claim:

1. An electrical connector for receiving tab terminals, comprising:

a. a housing of insulative material with a passage therethrough and a pin mounted in the housing and extending across the passage; and b. a conductive contact unit consisting of two, elongated, spaced apart, parallel elements with the adjacent free ends defining a tab terminal-receiving receptacle, said elements being joined intermediate the free ends by a center section extending therebetween, said section having an elongated slot extending therethrough normal to the axis of the unit, said unit being mounted on the pin with the pin passing through the slot so that the unit may both pivot about and move up and down the pin.

2. The electrical connector of claim 1 wherein a plurality of units are mounted side-by-side on the pin with a low friction plastic spacer positioned between each unit.

3. The electrical connector of claim 2 wherein one of said units is longer than the other units and is made from a high resistance material.

4. The electrical connector of claim 3 wherein the free ends of the longer unit are plated with a hard substance.

* * * * *